US009614264B2

(12) United States Patent
Hendry et al.

(10) Patent No.: US 9,614,264 B2
(45) Date of Patent: Apr. 4, 2017

(54) FILTER

(71) Applicant: MESAPLEXX PTY LTD, Eight Mile Plains (AU)

(72) Inventors: David R. Hendry, Brisbane (AU); Steven J. Cooper, Brisbane (AU); Peter B. Kenington, Chepstow (GB)

(73) Assignee: MesaplexxPty Ltd, Queensland (AU)

( * ) Notice: Subject to any disclaimer, the term of this patent is extended or adjusted under 35 U.S.C. 154(b) by 7 days.

(21) Appl. No.: 14/134,965

(22) Filed: Dec. 19, 2013

(65) Prior Publication Data

US 2015/0180103 A1 Jun. 25, 2015

(51) Int. Cl.
*H01P 1/20* (2006.01)
*H01P 1/208* (2006.01)

(52) U.S. Cl.
CPC ..... *H01P 1/2002* (2013.01); *H01P 1/2086* (2013.01)

(58) Field of Classification Search
CPC ..... H01P 1/2002; H01P 1/20
USPC ..... 333/202, 219.1
See application file for complete search history.

(56) References Cited

U.S. PATENT DOCUMENTS 2,890,421 A 6/1959 Currie
3,657,670 A * 4/1972 Kitazume et al. ..... H01P 1/212 333/209
4,142,164 A 2/1979 Nishikawa et al.
4,614,920 A 9/1986 Tong
4,622,523 A 11/1986 Tang
4,623,857 A 11/1986 Nishikawa et al.
4,630,009 A 12/1986 Tang
4,644,305 A 2/1987 Tang et al.
4,675,630 A 6/1987 Tang et al.
4,792,771 A 12/1988 Siu
4,879,533 A 11/1989 de Muro et al. ..... 333/206
4,963,844 A 10/1990 Konishi et al. ..... 333/208
5,023,866 A 6/1991 De Muro ..... 370/24
5,307,036 A 4/1994 Turunen et al. ..... 333/202
5,325,077 A 6/1994 Ishikawa et al.
5,589,807 A 12/1996 Tang
(Continued)

FOREIGN PATENT DOCUMENTS

CA 1189154 A2 6/1985
CA 1194157 A1 9/1985
(Continued)

OTHER PUBLICATIONS

Awai, Ikuo, et al; Equivalent-Circuit Representation and Explanation of Attenuation Poles of a Dual-Mode Dielectric-Resonator Bandpass Filter; Transactions on Microwave Theory and Techniques; (Dec. 1998); pp. 2159-2163; vol. 46; No. 12; IEEE.
(Continued)

*Primary Examiner* — Benny Lee
*Assistant Examiner* — Gerald Stevens
(74) *Attorney, Agent, or Firm* — Harrington & Smith

(57) ABSTRACT

The present invention provides multi-resonator cavity filters in which one or more patch elements are introduced into the coupling apertures between resonators, reducing the strength of the electric field in the aperture gap while maintaining the coupling strength from resonator to resonator. This reduced field strength reduces the sensitivity of the resonators to gap-thickness variations, and allows use of the filter in high-power applications.

15 Claims, 4 Drawing Sheets

(56) References Cited

U.S. PATENT DOCUMENTS

| | | | | |
|---|---|---|---|---|
| 5,926,079 | A | 7/1999 | Heine et al. | 333/208 |
| 6,016,091 | A * | 1/2000 | Hidaka et al. | H01P 1/2084 333/202 |
| 6,025,291 | A | 2/2000 | Murakawa | 501/136 |
| 6,066,996 | A | 5/2000 | Goertz et al. | |
| 6,133,808 | A | 10/2000 | Arakawa | 333/134 |
| 6,160,463 | A * | 12/2000 | Arakawa et al. | H01P 1/2056 333/202 |
| 6,346,867 | B2 | 2/2002 | Arakawa et al. | 333/208 |
| 6,549,094 | B2 | 4/2003 | Takagi et al. | 333/134 |
| 6,677,837 | B2 | 1/2004 | Kojima et al. | 333/208 |
| 6,825,740 | B2 | 11/2004 | Kundu | 333/202 |
| 7,138,891 | B2 | 11/2006 | Andoh et al. | |
| 7,714,680 | B2 | 5/2010 | Vangala et al. | 333/134 |
| 8,022,792 | B2 | 9/2011 | Howard | |
| 8,823,470 | B2 | 9/2014 | Vangala | 333/212 |
| 9,030,278 | B2 | 5/2015 | Vangala | 333/208 |
| 9,030,279 | B2 | 5/2015 | Vangala | 333/202 |
| 2001/0000429 | A1 | 4/2001 | Arakawa et al. | 333/208 |
| 2001/0024147 | A1 | 9/2001 | Arakawa et al. | 333/135 |
| 2002/0024410 | A1 | 2/2002 | Guglielmi et al. | 333/202 |
| 2002/0039058 | A1* | 4/2002 | Sano et al. | 333/202 |
| 2003/0006864 | A1 | 1/2003 | Hattori et al. | |
| 2003/0090344 | A1 | 5/2003 | Wang et al. | 333/202 |
| 2003/0141948 | A1 | 7/2003 | Maekawa et al. | |
| 2003/0227360 | A1 | 12/2003 | Kirihara et al. | 333/239 |
| 2004/0041660 | A1 | 3/2004 | Kawahara et al. | |
| 2004/0056736 | A1 | 3/2004 | Enokihara et al. | 333/202 |
| 2005/0128031 | A1 | 6/2005 | Wilber et al. | 333/202 |
| 2005/0140474 | A1 | 6/2005 | Kim et al. | 333/219.1 |
| 2005/0253672 | A1 | 11/2005 | Enokihara et al. | 333/219.1 |
| 2006/0139127 | A1 | 6/2006 | Wada et al. | |
| 2008/0018391 | A1 | 1/2008 | Bates | 327/557 |
| 2008/0061905 | A1 | 3/2008 | Ishikawa | |
| 2008/0211601 | A1* | 9/2008 | Bates | 333/186 |
| 2010/0231323 | A1 | 9/2010 | Vangala et al. | |
| 2011/0006856 | A1 | 1/2011 | Kim et al. | |
| 2011/0128097 | A1 | 6/2011 | Park et al. | |
| 2014/0077900 | A1* | 3/2014 | Rogozine et al. | 333/212 |

FOREIGN PATENT DOCUMENTS

| | | | |
|---|---|---|---|
| EP | 0883203 | A3 | 10/1999 |
| EP | 0751579 | B1 | 11/2002 |
| EP | 0656670 | B1 | 1/2003 |
| EP | 1458051 | A1 | 9/2004 |
| JP | H0216801 | | 1/1990 |
| JP | 10284988 | | 1/1998 |
| JP | 1079636 | | 3/1998 |
| JP | 10209808 | | 8/1998 |
| JP | 10224113 | | 8/1998 |
| JP | 10294644 | | 11/1998 |
| JP | 2000295072 | A | 10/2000 |
| JP | 2002135003 | A | 5/2002 |
| JP | 2003037476 | A | 2/2003 |
| JP | 2003188617 | A | 7/2003 |
| JP | 2003234635 | A | 8/2003 |
| JP | 2004312287 | A | 11/2004 |
| JP | 2004312288 | A | 11/2004 |
| JP | 2005065040 | A | 3/2005 |
| JP | 2005167577 | A | 6/2005 |
| JP | 2005223721 | A | 8/2005 |
| WO | WO-9301626 | A1 | 1/1993 |
| WO | WO-0077883 | A1 | 12/2000 |
| WO | WO-02078119 | A1 | 10/2002 |
| WO | WO-2009029282 | A1 | 3/2009 |

OTHER PUBLICATIONS

Awai, Ikuo, et al; Coupling of Dual Modes in a Dielectric Waveguide Resonator and its Application to Bandpass Filters; Proceedings of the 25th European Microwave Conference; (1995); pp. 533-537; Conf. 25; Yamaguchi University, Japan.

Weily, Andrew R, et al; Rotationally Symmetric FDTD for Fast Design and Wideband Spurious Performance Prediction of Dielectric Resonator Filters; Telecom Group, Falculty of Engineering, University of Technology; (1999); pp. 844-847.

Chaudhary, Raghvendra Kumar, et al.; Multi-Layer Multi-Permittivity Dielectric Resonator: A New Approach for Improved Spurious Free Window; Proceedings of the 40th European Microwave Conference; (Sep. 28-30, 2010); pp. 1194-1197; Paris, France.

Sano, Kazuhisa, et al.; Application of the Planar I/O Terminal to Dual Mode Dielectric Waveguide Filters; International Microwave Symposium Digest; (Jun. 11-16, 2000); pp. 1173-1176; Boston, MA.

Wang, Chi, et al; A Practical Triple-Mode Monoblock Bandpass Filter for Base Station Applications; MTT-S Digest; (2001); pp. 1783-1786.

Awai, Ikuo, et al; A Dual Mode Dielectri Waveguide Resonator and its Application to Bandpass Filters; IEICE Transactions on Electronics; (Aug. 1995); pp. 1018-1025; vol. E78-C; No. 8.

Bekheit, Maged, et al.; Modeling and Optimization of Compact Microwave Bandpass Filters; IEEE Transactions of Microwave Theory and Techniques; (Feb. 2008); pp. 420-430; vol. 56; No. 2.

Dupont, "Properties Handbook", Dupont, p. 4 (30 pgs.), Nov. 2003.

Trak Ceramics, "Dielectric Materials", TRAK Ceramics, Inc., p. 1 (8 pgs.).

* cited by examiner

FILTER

TECHNICAL FIELD

The present invention relates to filters, and in particular to a filter including two or more resonator bodies for use, for example, in frequency division duplexers for telecommunication applications.

BACKGROUND

Single-mode dielectric filters are in widespread use in many communications systems, including both low- and high-power use within the cellular communications industry. In particular, duplex filters, used in many handsets will typically employ this form of filter technology and some higher power applications exist, although the high losses associated with commercial products typically restrict their use to power levels of a few watts (mean) or less.

Interest in the use of multi-mode filters is growing, since these filters allow the same piece of dielectric material (or 'puck') to be, effectively, re-used multiple times, to form a more complex filter characteristic. This will have, typically, a steeper roll-off and a wider pass-band bandwidth than an equivalent single-mode resonator could achieve. It will also, typically, result in lower losses, due to the reduction in the number of times the signal needs to be coupled into and out of the dielectric material. A typical example would be a triple mode filter, in which the dielectric material is excited in three dimensions or 'planes'—the X-plane, the Y-plane and the Z-plane. The excitation can be in the form of H-field (magnetic) or E-field (electric) or a combination of the two (in any ratio).

The structure (whether multi-mode or single-mode) is that of a cavity filter. A piece of dielectric material (puck) is coated with conductive material with the exception of at least one aperture which allows the unfiltered signal to be input to the dielectric material, and the filtered signal to be output from the dielectric material. This is a widely-used and inherently low loss structure. A cavity resonator spreads the current out evenly over the whole surface and so minimises the current concentration over that surface. By contrast, a combline filter, for example, concentrates the current on the central rod, so the current is not evenly distributed and hence the filter has generally higher losses.

In order to achieve a steep roll-off, together with a wide pass-band bandwidth, it may be desirable to cascade a plurality of resonators in series. This process will typically result in a significant increase in the loss in the (wanted) pass-band, due to both the insertion loss of the dielectric material itself (i.e. the dielectric losses within that material) and the coupling losses in transferring energy into and out of the dielectric.

In practice, however, the use of multiple resonators connected in series raises difficulties. For example, resonators may be coupled together by placing an aperture in the conductive coating of one resonator next to a corresponding aperture in the coating of an adjacent resonator. Gaps between resonators are inevitable in a practical multi-resonator filter, due to imperfections in the uniformity of the conductive coating (for example) surrounding the resonators, together with the basic thickness of that coating. The coatings of adjacent resonators will touch at locations where they are thickest, while gaps will be formed where the coatings are thinner. These gaps, together with the intrinsic thickness of the silvering, create a void between the two apertures. The presence of this void has two consequences for an aperture-coupled filter:

1. The introduction of a small amount of a dielectric (air) with a very differing dielectric constant to the dielectric of the resonators, may lead to a shift in the resonant frequency of the resonators. Whilst it is theoretically possible to compensate for this shift at the design stage of the filter, its unpredictability, due to the unpredictability of the size of the gap for a given manufactured example of the filter, makes full compensation at the design stage essentially impossible. Whilst this residual, unpredictable, frequency shift may not be large in percentage terms, it can be catastrophic for a tightly-specified filter, with a narrow pass-band made up of the juxtaposition of multiple resonances. Note that in the case of a multi-mode resonator, this shift may be significantly greater for one mode than for the others, which will not only alter the overall centre frequency, but also significantly impact the filter's passband shape (e.g. ripple).

2. The very high electric field present in the small air gap is the primary source of breakdown and hence the primary limitation on the ability of a filter to handle high power signals in many designs.

A filter is desired which alleviates these and other problems.

SUMMARY OF INVENTION

According to an aspect of the present invention, there is provided a cavity filter, comprising: first and second dielectric resonator structures comprising respective pieces of dielectric material, each piece of dielectric material having a shape such that it can support at least one resonant mode for an electromagnetic signal having a given frequency, wherein each dielectric resonator structure is substantially coated in a conductive material, wherein at least one of the first and second dielectric resonator structures comprises an aperture in its respective conductive coating for receiving a signal to be filtered, or for outputting a filtered signal, and wherein the first and second dielectric resonator structures each comprise a coupling aperture in their respective conductive coatings, the coupling apertures being in communication with each other for passing electromagnetic energy between the first and second dielectric resonator structures; and a patch element located in the coupling apertures, having a shape and size such that the patch element is non-resonant for the electromagnetic signal having the given frequency.

BRIEF DESCRIPTION OF THE DRAWINGS

For a better understanding of the present invention, and to show more clearly how it may be carried into effect, reference will now be made, by way of example, to the following drawings, in which.

DETAILED DESCRIPTION

Figure 1:
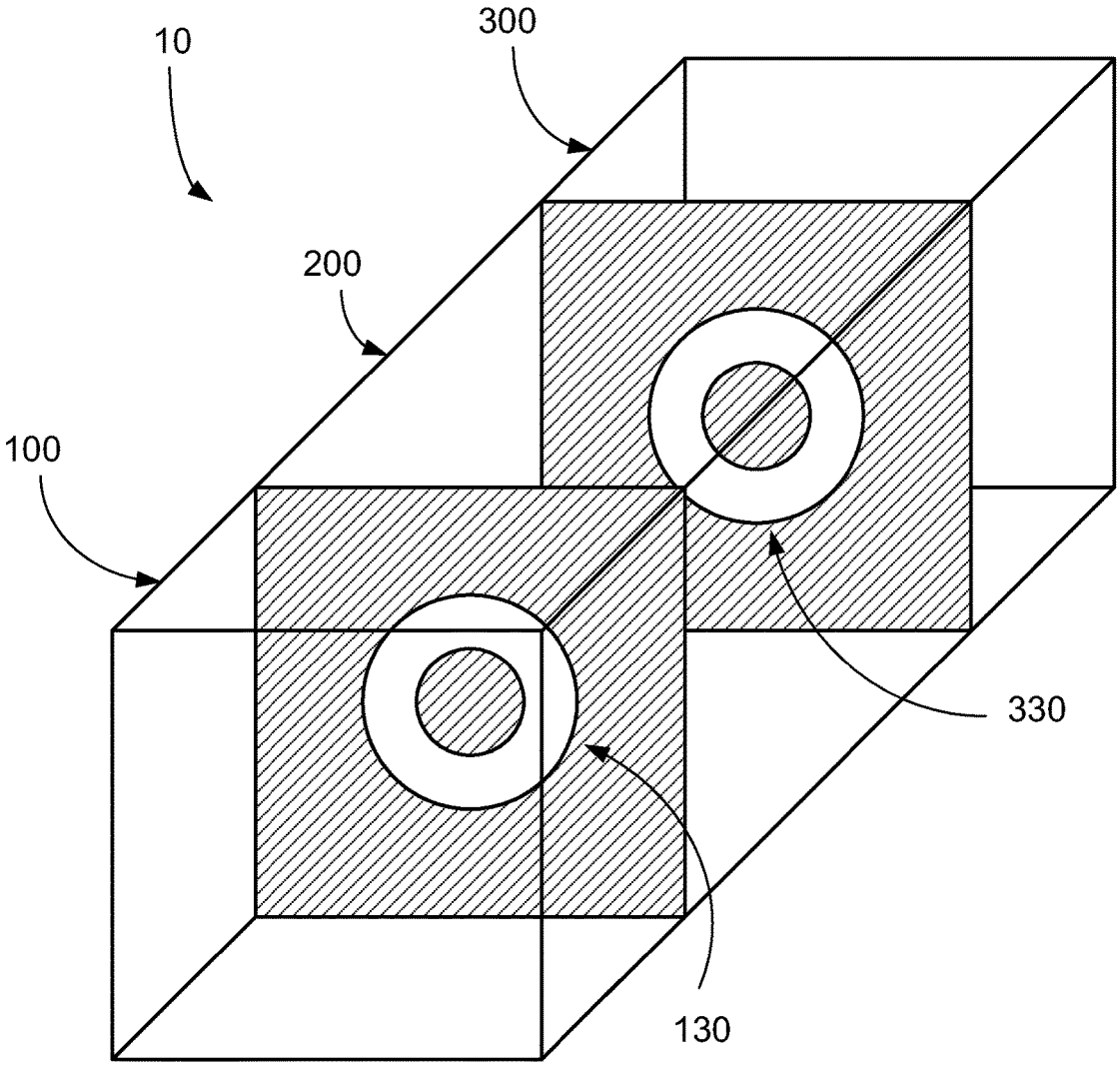
FIG. 1 shows a multi-resonator filter according to embodiments of the invention.
Figure 2:
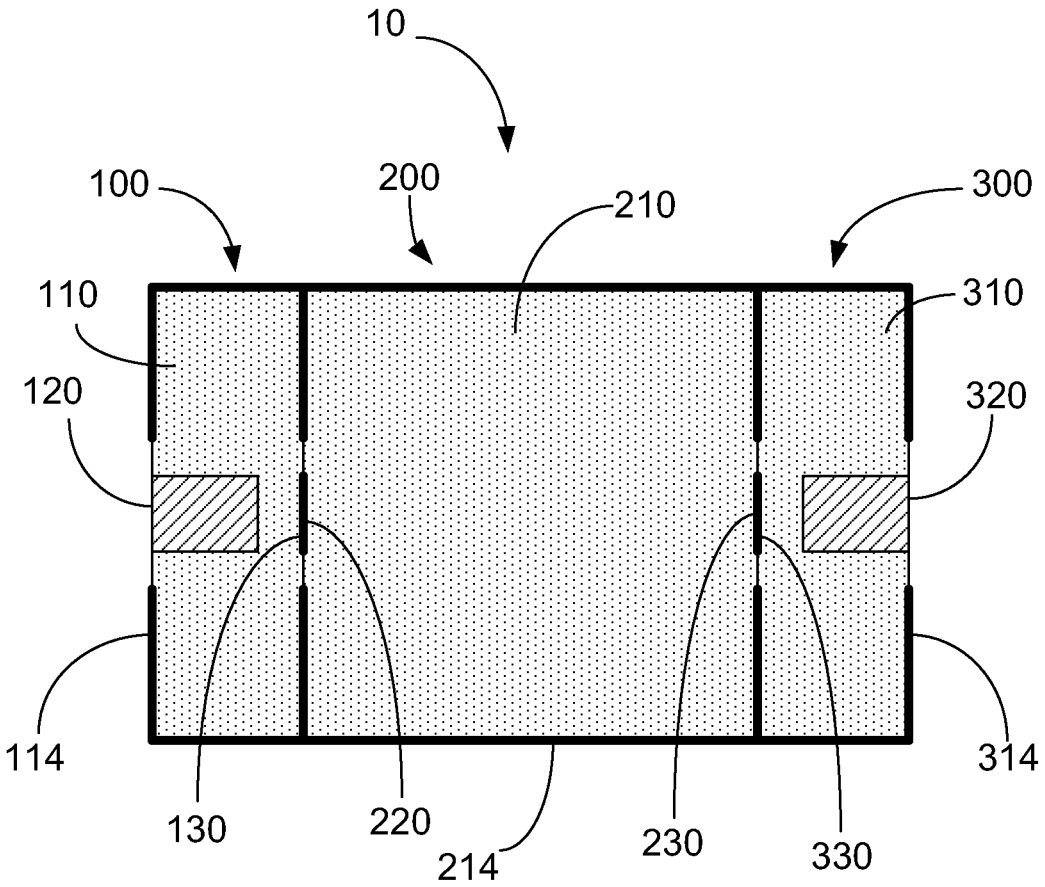
FIG. 2 shows a plan view of the filter shown in FIG. 1.

FIG. 1 shows a filter 10 according to embodiments of the invention, comprising multiple resonators coupled in series. FIG. 2 shows the filter 10 in a plan view.

The filter 10 comprises an input single-mode resonator 100, coupled to a multi-mode resonator 200, which is in turn coupled to an output single-mode resonator 300.

The input resonator 100 comprises a resonator body 110, an input coupling structure 120 and an intermediate coupling structure 130. Typically the resonator body 110 includes, and more typically is manufactured from, a solid body of a dielectric material having suitable dielectric properties. In one example, the resonator body is a ceramic material, although this is not essential and alternative materials can be used. Additionally, the body can be a multilayered body including, for example, layers of materials having different dielectric properties. In one example, the body can include a core of a dielectric material, and one or more outer layers of different dielectric materials.

The resonator body 110 comprises an external coating of conductive material 114, such as silver, although other materials could be used such as gold, copper, or the like. The conductive material may be applied to one or more surfaces of the resonator body 110. Respective apertures in the coating 114 may be provided around the input coupling structure 120 and the intermediate coupling structure 130 to allow coupling of signals to and from the resonator body 110.

In use, the input coupling structure 120 allows an unfiltered signal to be applied to the filter 10 and particularly to the resonator body 110. In the illustrated embodiment, the input coupling structure 120 comprises a probe 120 inserted part way into the resonator body 110, to which a signal is applied. However, various alternative means for coupling an electromagnetic signal to the resonator body 110 are described in the Applicant's earlier applications (U.S. patent application Ser. Nos. 13/488,059, 13/488,123, 13/488,172, 13/488,234, 13/530,913, 13/531,003, 13/531,084 and 13/531,169) and those skilled in the art will appreciate that any of these structures or alternative means for coupling signals to the body 110 may be utilized without departing from the scope of the invention.

The intermediate coupling structure 130 consists of a single conductive patch element positioned within an aperture of the coating 114 extending adjacent at least part of a surface of the resonator body 110. As will be described in greater detail below, the intermediate coupling structure 130 allows for coupling of signals from the resonator body 110 to a second resonator body. The patch element is shaped and sized so that it is non-resonant at excitation frequencies where the resonant body 110 (and the resonant body 210 of the multi-mode resonator 200) are resonant. For example, the patch element may be of a size such that it does not resonate to a significant degree at the passband frequencies of interest. In one embodiment, the patch element is shaped and/or sized such that it is too small to resonate at the passband frequencies of interest.

The resonator body 110 can be any shape. In the illustrated example, the resonator body 110 is a rectangular cuboid body, and therefore defines three orthogonal axes substantially aligned with surfaces of the resonator body, as shown by the axes X, Y, Z. The resonator body 110 has a square cross section, but is relatively narrow. As a result, the resonator body 110 has a single dominant resonance mode.

In general, cuboid structures are particularly advantageous as they can be easily and cheaply manufactured, and can also be easily fitted together, for example by arranging multiple resonator bodies in contact. Cuboid structures typically have clearly defined resonance modes, making configuration of the coupling structure more straightforward. Additionally, the use of a cuboid structure provides a planar surface so that the coupling structure 130 can be arranged in a plane parallel to the planar surface, with the patch element being in contact with the resonator body 110. This can help maximise coupling between the coupling structure 130 and resonator body 110, as well as allowing the coupling structure 130 to be more easily manufactured.

The filter 10 further comprises a multi-mode resonator 200 which is positioned adjacent the input resonator 100. The multi-mode resonator 200 comprises a resonator body 210, a first intermediate coupling structure 220 (for coupling to the input resonator 100) and a second intermediate coupling structure 230 (for coupling to the output resonator 300). Similar to the input resonator 100, the resonator body 210 includes dielectric material having suitable dielectric properties, and is surrounded by a coating 214 of conductive material (such as silver, etc). The coating has respective apertures for each of the coupling structures 220, 230.

The first intermediate coupling structure 220 consists of a single conductive patch element positioned within an aperture of the coating 214, extending adjacent to at least part of a surface of the resonator body 210. The first intermediate coupling structure 220 extends towards the intermediate coupling structure 130 of the input resonator 100. The patch elements are brought into direct electrical contact with each other. Similar to the coupling structure 130, the patch element of the first intermediate coupling structure 220 is shaped and sized so that it is non-resonant at excitation frequencies where the resonant body 210 (and the resonant body 110 of the input resonator 100) are resonant.

The multi-mode resonator body 210 differs from the input resonator body 110 in that it is cuboid. As a result, the resonator body 110 has three dominant resonance modes that are substantially orthogonal and substantially aligned with the three orthogonal axes.

The second intermediate coupling structure 230 also consists of a single conductive patch element positioned within an aperture of the coating 214, extending adjacent to at least part of a surface of the resonator body 210. In the illustrated embodiment the second intermediate coupling structure 230 is located on a face of the body 210 opposite that of the first intermediate coupling structure 220, but this is not essential.

The output resonator 300 is substantially similar to the input resonator 100, and comprises a resonator body 310, an intermediate coupling structure 330, and an output coupling structure 320. The resonator body 310 comprises dielectric material, and is shaped as a rectangular cuboid, thus supporting a single resonant mode (and, in the illustrated embodiment, the same resonant mode as supported by the input resonator 100). The output coupling structure 320 comprises a probe positioned within an aperture of the conductive coating 314 and extending at least partially into the resonator body 310, similar to the input coupling structure 120. As outlined above with respect to the input coupling structure 120, the output coupling structure may comprise a different output mechanism without departing from the scope of the invention. Further, the output coupling structure 320 may comprise the same or a different coupling mechanism to that of the input coupling structure 120.

The intermediate coupling structure 330 consists of a single conductive patch element positioned within a respective aperture of the coating 314, extending adjacent to at least part of a surface of the resonator body 310. The intermediate coupling structure 330 extends towards the second intermediate coupling structure 230 of the multi-mode resonator 200. As with the intermediate coupling structures between the input and multi-mode resonators 100, 200, the coupling structures 230, 330 extend towards each other and come into direct electrical contact.

The illustrated embodiments show patch elements which are circular. Circular patch elements ensure that the charge is evenly distributed about the patch element rather than being concentrated at an acute corner thereof. However, satisfactory performance may be achieved with patch elements of any arbitrary shape, provided the shape and size of the patch elements are such that it is non-resonant.

The illustrated embodiments show patch elements which are concentrically positioned within apertures having the same geometric shape. Again, this arrangement ensures that the electric field between the patch element and the surrounding coating is uniform and reduces the risk of arcing. However, satisfactory performance may again be achieved by patch elements and apertures which are non-concentric and/or do not have the same shape.

In the filter 10 illustrated with respect to FIGS. 1 and 2, intermediate coupling structures which are brought together have substantially identical, complementary shapes such that a circular patch element (say) on one resonator meets an identical circular patch element on another resonator. This ensures the maximum transfer of energy from one resonator to the other.

The coupling structures can be formed using one of the standard techniques known to those skilled in the art, such as by patterning a mask in the conductive coating (using printing techniques or photoresist) and then etching the exposed parts to create the coupling structure. Alternatively the coupling structure may be milled into the conductive layer surrounding the resonator bodies. Etching ensures that the thickness of the patch elements is the same as the thickness of the surrounding coating. In this way, the patch elements of respective resonators are more likely to come into close electrical contact when those resonators are placed together. A planarization process (such as lapping) could also be used to bring the coating and patch element outer surfaces to the same thickness.

The basic operation of the filter 10 is as follows. A signal to be filtered is input to the input resonator 100 via the input coupling mechanism 120, and excites the single resonant mode of the resonator body 110. The E-field present at the centre of the coupling face of the input resonator 110, which would otherwise flow directly through the aperture, from the input resonator body 110 to the multi-mode resonator body 210, is received by the patch element 130 located in the centre of the aperture on the coupling face of the input resonator body 110. The patch 130 capacitively couples to the input resonator body 110, receiving a portion of the E-field energy from the input resonator body 110. This portion of the E-field present in the input resonator 110 thereby induces a current flow through the patch 130 and, since that patch is, at least partially, in electrical contact with the patch 220 in the centre of the face of the multi-mode resonator body 210, this current also flows through that second patch 220. The second patch 220 then acts as a radiating element and generates an E-field in the multi-mode resonator body 210 as a result of the induced current flowing in the patch 220. A portion of the E-field present in the input resonator body 110 has thus been transferred to the multi-mode resonator body 210 without significant amounts of E-field having had to traverse the small air gap which typically exists between adjacent dielectric surfaces of the input resonator body 110 and the multi-mode resonator body 210.

In a similar fashion, the E-field present at the centre of the opposite face of the multi-mode resonator body 210 is received by the patch element 230 located in the centre of the aperture on that face. The current induced as a result flows to the patch element 330 in the output resonator 300, and this patch element 330 radiates an E-field into the output resonator body 310. A portion of the E-field in the multi-mode resonator body 210 has thus been transferred to the output resonator body 310. The E-field in the output resonator body 310 induces a current in the output coupling mechanism 320, and a filtered signal is output from the filter 10.

The E-field of the mode being coupled by the aperture is typically at its strongest in the centre of the coupling face of each resonator body, and hence the coupling aperture is typically placed at this point (as shown in FIG. 1 and FIG. 2), although this is not essential to the operation of the invention. The coupling patch would also, typically, be placed in the centre of the aperture and would typically have the same shape as the aperture, although neither is essential to the operation of the invention.

The size of the gap between the patch element and the surrounding conductive coating (i.e. the relative size of the aperture and the patch element) may also have an impact on the performance of the filter 10.

That is, in different regions of the filter passband the electric fields within different resonators will vary both in magnitude and relative direction. At certain frequencies the electric field on both sides of the aperture will be strong, with the electric field on one side of the aperture pointing directly towards the aperture and the electric field on the other side of the aperture pointing away from the aperture, forming an antisymmetrical field pattern. At certain other frequencies the electric field will be strong and point away from (or towards) the aperture on both sides, forming a symmetrical field pattern. In the antisymmetrical case, the electric field in the gap between the patch element and the edge of the aperture in the conductive coating will be minimised by making the gap as small as possible. In the symmetrical case, the electric field in the gap will be minimised when the gap is as large as possible. In some embodiments of this invention, this gap may be chosen so as to compromise between these two cases, making the electric field strengths as a result of the symmetrical and antisymmetrical field patterns approximately equal. This will improve the power handling capability of the filter across the whole passband.

If the aperture and/or patch are displaced from the centre of the face, then a significant amount of H-field will be present at this displaced location and, assuming that H-field coupling is also desired (which is typically the case for a multi-mode filter), then the design of the aperture and patch will typically need to be modified, in order to accommodate a degree of H-field coupling. For example, a pair of narrow openings, or 'slots', may be made in the coating, close to the periphery of the coupling face of the resonator body. E-field coupling, even at an off-centre location, will still take place using the conduction mechanism described above, however.

Figure 3A:
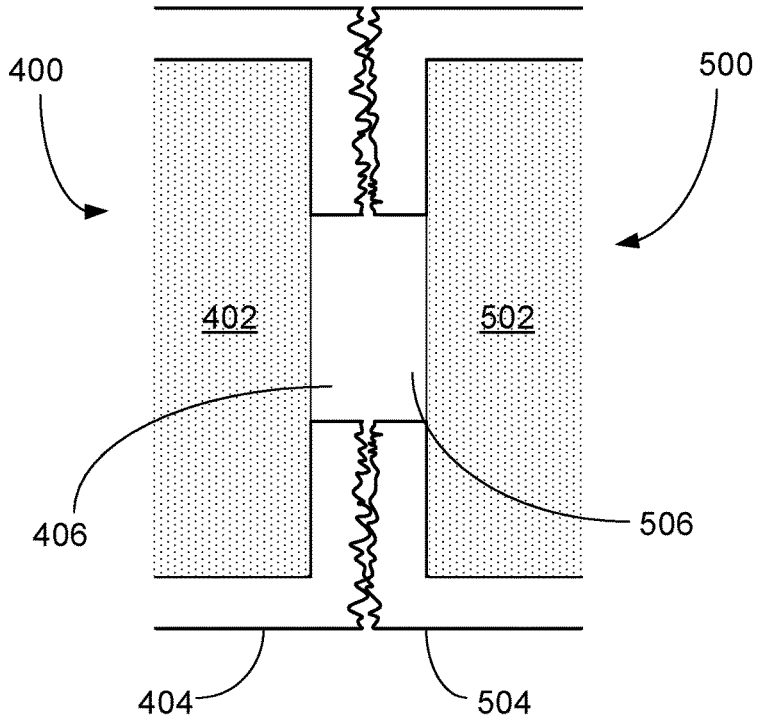
Fig. 3a (Prior Art)
FIG. 3*a* shows a detailed view of conventional aperture coupling between adjacent resonators.
Figure 3B:
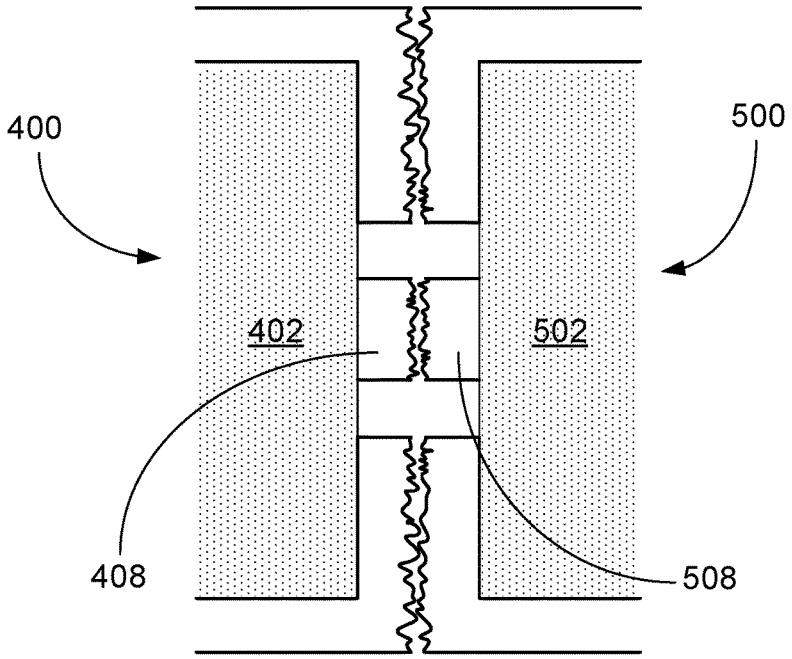
FIG. 3*b* shows a detailed view of aperture coupling between adjacent resonators according to embodiments of the invention.

FIGS. 3*a* and 3*b* show the action of the patch elements in more detail. FIG. 3*a* shows a conventional coupling between resonators 400, 500. The resonators comprise respective dielectric resonator bodies 402, 502 surrounded by respective conductive coatings 404, 504. The thickness of the coatings is greatly exaggerated for illustrative purposes. In each coating is formed a respective coupling aperture 406, 506 and these are placed together. FIG. 3*a* also shows (again exaggerated for illustrative purposes) the lack of uniformity in the coatings 404, 504, which is inevitable in any practical product.

When placed together, the two apertures 406, 506 leave a significant air gap which makes the coupling strength and hence accuracy of the filter response very sensitive to variations in the thickness of the coatings 404, 504, as well as severely limiting the power which the resonators can handle without breakdown and arcing from one to the other.

FIG. 3*b* shows the same pair of resonators 400, 500 with the addition of patch elements 408, 508 according to embodiments of the invention. The variation in the thickness of the elements is again exaggerated for illustrative purposes. The patch elements 408, 508 are each located within the aperture 406, 506 of their respective resonators, and come into as close contact as their non-uniform thicknesses will allow. Even if non-uniform electrical contact is achieved, however, the presence of the patch elements within the aperture will greatly reduce the possibility of arcing due to air gaps between the resonators and also reduce the impact of the unpredictability of the air gap, when considering manufactured samples of the filter, upon each resonator's frequency response.

In the illustrated embodiments, the patch elements appear as islands, with no connection to the surrounding metallisation. However, it is not essential for the patch elements to be completely isolated. For example, the patch element could be joined to the surrounding metallisation by one or more narrow bridges of conductive material. As long as these bridges are sufficiently small to ensure that they did not eliminate all of the current present in the patch element (i.e. shorting all of the current to the surrounding metallisation), then some E-field would still be evident and this E-field could still be transferred from one resonator to an adjacent resonator by the mechanism described above. Such bridges could be used to limit or control the E-field or H-field coupling strength as required by the designer.

The embodiments described above show the use of patch elements to couple single-mode resonators to a multi-mode resonator in a filter comprising a single-mode input resonator, a multi-mode resonator and a single-mode output resonator connected in series. The patch elements may, however, be used for coupling from a single-mode resonator to another single-mode resonator, a single-mode resonator to a multi-mode resonator, a multi-mode resonator to single-mode resonator, or a multi-mode resonator to another multi-mode resonator. Moreover, filters according to the present invention may comprise two or more resonators arranged in any combination of single-mode or multi-mode resonators. When coupling to or from a multi-mode resonator, additional coupling structures may also be provided to facilitate coupling of the H-field in one or more orthogonal directions; in this way all three modes may be excited in the multi-mode resonator. The present application is focussed on coupling of the E-field between resonators, however.

Figure 4A:
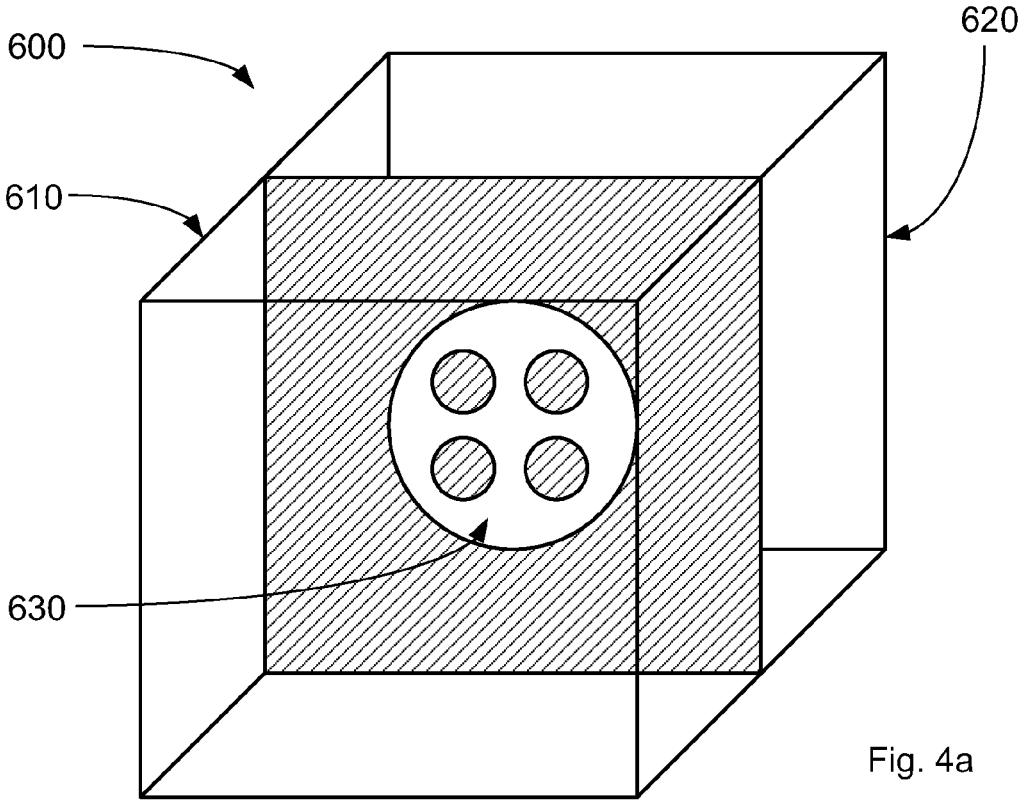
FIGS. 4*a* and 4*b* show filters according to further embodiments of the invention.

FIG. 4*a* shows a filter 600 according to further embodiments of the invention.

The filter 600 comprises a first resonator 610 and a second resonator 620. The details of the resonators are not shown for clarity, but they are substantially similar to those described above, and may support single or multiple modes of resonance. That is, each resonator has a dielectric resonator body and a conductive coating, and each resonator has a coupling aperture in the coating which allows signals in one resonator body to be passed to the other.

The filter 600 differs from those described above in that multiple patch elements 630 are located within each aperture. The patch elements may be distributed evenly about the centre of the coupling face (in the same way that the single patch elements referred to above may be located at the centre of the coupling face).

Figure 4B:
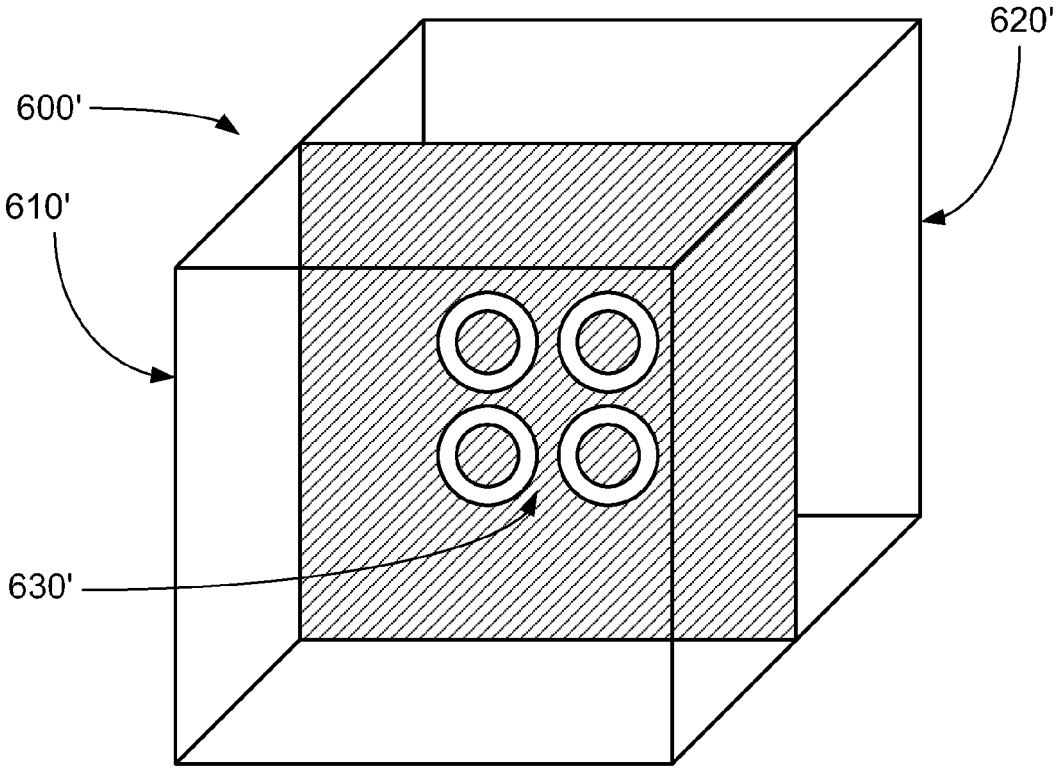

FIG. 4*b* shows a further filter 600' according to embodiments of the present invention. The filter 600' is similar to that described above with respect to FIG. 4*a*, but each patch element 630' is located within its own respective aperture. Thus, in this embodiment, both the apertures and the patch elements may be distributed evenly about the centre of the coupling face.

The present invention thus provides multi-resonator cavity filters in which one or more patch elements are introduced into the coupling apertures between resonators, reducing the strength of the electric field in the aperture gap while maintaining the coupling strength from resonator to resonator. This reduced field strength reduces the sensitivity of the resonators to gap-thickness variations, and allows use of the filter in high-power applications.

Those skilled in the art will appreciate that various amendments and alterations can be made to the embodiments described above without departing from the scope of the invention as defined in the claims appended hereto.

The invention claimed is:

1. A cavity filter, comprising:

first and second dielectric resonator structures comprising respective pieces of dielectric material, each piece of dielectric material having a shape such that it can support at least one resonant mode for an electromagnetic signal having a given frequency, wherein each dielectric resonator structure is substantially coated in a conductive material, wherein at least one of the first and second dielectric resonator structures comprises an aperture in its respective conductive coating for receiving an unfiltered signal, or for outputting a filtered signal, and wherein the first and second dielectric resonator structures each comprises a coupling aperture in its respective conductive coating, the coupling apertures being in communication with each other for passing electromagnetic energy between the first and second dielectric resonator structures; and a patch element located in the coupling apertures, having a shape and size such that the patch element is non-resonant for the electromagnetic signal having the given frequency, wherein the patch element increases power handling capability of the cavity filter relative to without having the patch element and reduce sensitivity to variations in thicknesses of the conductive material, wherein a gap between the patch element and an edge of the coupling apertures is sized to increase the power handling capability of the cavity filter across a whole passband relative to without selecting the size, wherein the size of the gap is selected such that an electric field in the gap as a result of a symmetric electric field pattern in the first and second dielectric resonator structures is equal to an electric field in the gap as a result of an antisymmetric electric field pattern in the first and second dielectric resonator structures.

2. The cavity filter as recited in claim 1, wherein the size of the patch element is smaller than the size required to make the patch element resonant for the electromagnetic signal having the given frequency.

3. The cavity filter as recited in claim 1, wherein the patch element has a single, smooth, continuous curved edge.

4. The cavity filter as recited in claim 3, wherein the patch element is circular.

5. The cavity filter as recited in claim 1, wherein the patch element and the coupling apertures have geometrically similar shapes.

6. The cavity filter as recited in claim 1, wherein the coupling apertures are positioned centrally within respective faces of the pieces of dielectric material.

7. The cavity filter as recited in claim 1, wherein the patch element is in direct electrical contact with the piece of dielectric material in the first dielectric resonator structure and the piece of dielectric material in the second dielectric resonator structure.

8. The cavity filter as recited in claim 7, wherein the patch element comprises a first patch sub-element directly connected to the piece of dielectric material in the first dielectric resonator structure, and a second patch sub-element directly connected to the piece of dielectric material in the second dielectric resonator structure, and wherein the first and second patch sub-elements are electrically connected.

9. The cavity filter as recited in claim 1, wherein the patch element is positioned centrally within the coupling apertures.

10. The cavity filter as recited in claim 1, wherein each piece of dielectric material has a plurality of faces, and wherein the patch element is positioned centrally within one of the faces of each piece of dielectric material.

11. The cavity filter as recited in claim 1, comprising one or more further patch elements.

12. The cavity filter as recited in claim 11, wherein the patch element and the one or more further patch elements are located within the coupling apertures of the first and second dielectric resonator structures.

13. The cavity filter as recited in claim 11, wherein the first and second dielectric resonator structures each comprise one or more further coupling apertures in their respective conductive coatings, wherein the patch element and the one or more further patch elements are located within respective coupling apertures.

14. The cavity filter as recited in claim 11, wherein each piece of dielectric material has a plurality of faces, and wherein the patch element and the one or more further patch elements are uniformly distributed about a center of one of the faces of each piece of dielectric material.

15. The cavity filter as recited in claim 1, wherein the pieces of dielectric material are cuboid.

* * * * *